US005697019A

United States Patent [19]

Kim

[11] Patent Number: 5,697,019

[45] Date of Patent: Dec. 9, 1997

[54] CLEANING DEVICE OF CORONA CHARGING UNIT IN IMAGE FORMING APPARATUS

[75] Inventor: Jung-Hwan Kim, Seoul, Rep. of Korea

[73] Assignee: SamSung Electronics Co., Ltd., Kyungki-do, Rep. of Korea

[21] Appl. No.: 579,598

[22] Filed: Dec. 26, 1995

[30] Foreign Application Priority Data

Dec. 27, 1994 [KR] Rep. of Korea ..... 37372/1994

[51] Int. Cl.[6] ..... G03G 15/02

[52] U.S. Cl. ..... 399/100

[58] Field of Search ..... 355/215, 221; 361/229, 230; 250/324, 325, 326

[56] References Cited

U.S. PATENT DOCUMENTS

| | | | |
|---|---|---|---|
| 3,840,744 | 10/1974 | Hedman, Jr. | 355/215 |
| 3,842,273 | 10/1974 | Van Buskirk | 355/215 |
| 3,875,407 | 4/1975 | Hayne | 355/215 |
| 3,891,846 | 6/1975 | Ito | 355/215 |
| 3,942,006 | 3/1976 | Hayne | 355/215 |
| 3,978,379 | 8/1976 | Del Vecchio | 355/215 |
| 4,038,546 | 7/1977 | Jasinski | 355/215 |
| 4,811,050 | 3/1989 | Tanjo et al. | 355/221 |
| 4,864,363 | 9/1989 | Shinada | 355/133 |
| 4,956,671 | 9/1990 | Otsuka | 355/215 |
| 5,023,748 | 6/1991 | Okamoto et al. | 355/215 |
| 5,089,850 | 2/1992 | Ogura et al. | 355/215 |
| 5,194,897 | 3/1993 | Yoshiyama et al. | 355/215 |
| 5,250,991 | 10/1993 | Ikeda | 355/215 |
| 5,384,623 | 1/1995 | Ohashi et al. | 355/207 |
| 5,392,099 | 2/1995 | Kusumoto et al. | 355/221 |
| 5,485,251 | 1/1996 | Kita et al. | 355/215 |

FOREIGN PATENT DOCUMENTS

| | | |
|---|---|---|
| 1-195471 | 8/1989 | Japan . |
| 5-11573 | 1/1993 | Japan . |
| 5-289476 | 11/1993 | Japan . |

*Primary Examiner*—Arthur T. Grimley
*Assistant Examiner*—Sophia S. Chen
*Attorney, Agent, or Firm*—Robert E. Bushnell, Esq.

[57] ABSTRACT

A cleaning device of a charging unit in an image forming apparatus using an electrophotographic process for cleaning a corona wire. The cleaning device comprises an elongated shield case having a guide slit in a central portion extending in a lengthwise direction of a photosensitive drum; a cleaning shaft guide containing a bore therein, mounted to the guide slit and adapted to slide along the guide slit, a cleaning shaft having a handle and an integrally connected body inserted into the bore and adapted to maintain a cleaning member at a distance from the corona wire during non-cleaning of the corona wire, and to allow, upon application of force, the cleaning member to resiliently press against the corona wire and move along the corona wire while being held in frictional contact with the corona wire during cleaning of the corona wire by way of an elastic spring disposed between the handle of the cleaning shaft and the cleaning shaft guide.

25 Claims, 5 Drawing Sheets

CLEANING DEVICE OF CORONA CHARGING UNIT IN IMAGE FORMING APPARATUS

CROSS-REFERENCE TO RELATED APPLICATIONS

This application makes reference to, incorporates the same herein, and claims all benefits accruing under 35 U.S.C. §119 from an application for Cleaning Device For Corona Charging Unit In An Image Forming Apparatus earlier filed in the Korean Industrial Property Office on 27 Dec. 1994 and assigned Ser. No. 37372/1994.

BACKGROUND OF THE INVENTION

1. Technical Field

The present invention relates to an image forming apparatus using an electrophotographic process which includes a charging device for charging an image forming carrier with a corona discharge generated by a corona wire, and more particularly to a cleaning device for cleaning a corona wire in the image forming apparatus.

2. Background Art

In an image forming apparatus such as, for example, printer, copier, facsimile machine or the like using an electrophotographic process, an electrostatic latent image formed on a photosensitive drum is developed by charging a surface of the photosensitive drum with a corona discharge and then applying toner on the photosensitive drum. The developed image is then transferred and fixed onto a recording medium such as a cut sheet of paper.

Generally, as a unit for charging the surface of the photosensitive drum, a corona discharging wire (i.e., charging wire) is used for the production of an uniform electric field in response to application of high voltage to charge the surface of the photosensitive drum with high potential for enabling the photosensitive drum to attract toner and thereby form the latent image. Such charging device not only discharges harmful ozone which causes image blurring and shading due to the degradation of the surface of the photosensitive drum, but also causes undesirable adhesion of fine dust particles to the corona wire because of the high electric field formed on the surface of the charging wire whenever the corona wire generates a high discharge current. The fine dust particles typically include flying toner which is the residue of toner left on the surface of the photosensitive drum after an image transfer operation that has not been cleaned by a cleaning unit, dust entered into the image forming apparatus, and paper powder flaking off the recording paper. Therefore, the surface of the corona wire becomes contaminated and this contamination of the corona wire tends to produce an uneven discharge that results in an unevenness in the developed image. Hence, it is necessary to frequently remove and manually clean the corona wire as well as the inside of the charging unit.

Earlier designs for corona wire cleaning mechanisms such as disclosed in U.S. Pat. No. 3,840,744 for Apparatus Cleaning A Corona Discharge Strand issued to Hedman, Jr. involve a stationary cleaning mechanism having one or more elongated cleaning brushes, such as felt pads for cleaning a corona wire as the corona wire translates in a form of an endless loop around cleaning brushes by way of a motorized capstan. Other traditional corona wire cleaning mechanisms involve specific types of brushes or cleaning pads designed to traverse along the corona wire either by way of a pulley mechanism such as disclosed, for example, in U.S. Pat. No. 3,842,273 for Corona Generator Cleaning Apparatus issued to Van Buskirk, U.S. Pat. No. 5,023,748 for Corona Wire Cleaning Device For A Corona Unit issued to Okamoto et al., and U.S. Pat. No. 5,250,991 for Image Forming Apparatus Including Cleaning Means For Cleaning Charging Means issued to Ikeda.

Some require the corona wire cleaning mechanism to traverse along the corona wire by way of a feed screw such as disclosed, for example, in U.S. Pat. No. 4,864,363 for Cleaning Device For A Corona Discharger issued to Shinada, or even by way of manual force such as disclosed in U.S. Pat. No. 3,875,407 for Corona Generator Cleaning Apparatus issued to Hayne, U.S. Pat. No. 3,891,846 for Corona Discharger Cleaning Apparatus issued to Ito, and U.S. Pat. No. 3,978,379 for Corona Generating Device With An Improved Cleaning Mechanism issued to DelVecchio. In these earlier corona wire cleaning arrangements, the cleaning pads or brushes are designed to slide along the corona wire to clean the stains such as, for example, toner and paper powders adhered to the corona wire while being held in contact with the corona wire. However, these arrangements are not sufficient to clean the stains adhered to the corona wire completely. While the cleaning pads or brushes may be arranged to move back and forth along the corona wire plurality of times in order to ensure that the corona wire is cleaned, this has not been efficient. Moreover, since most cleaning pads or brushes are arranged in contact with the corona wire even when not cleaning, it has been my observation that the contact portion of the corona wire could not be efficiently charged which would lower the discharging efficiency of the charger and degrade the quality of reproduction.

More recent and sophisticated designs for cleaning mechanisms such as represented, for example, by U.S. Pat. No. 4,885,466 for Corona Wire Cleaning Device Utilizing A Position Detection System issued to Koichi et al., U.S. Pat. No. 4,956,671 for Wire Cleaning Device For A Corona Discharge Type Charger issued to Otsuka, U.S. Pat. No. 5,384,623 for Process Control Stabilizing System Including A Cleaning Device For The Corona Wires issued to Ohashi et at., U.S. Pat. No. 5,392,099 for Image Forming Apparatus Having Cleaning Member For Cleaning Charging Wire issued to Kusumoto et al., endeavor to devise a more efficient cleaning pad arranged to slide along the corona wire in order to clean the corona wire. For example, Kusumoto '099 employs a sophisticated optical detector for detecting a stained portion of the corona wire and controlling the speed of the cleaning member as the cleaning member moves across the stained portion in order to increase the frictional resistance between the corona wire and the cleaning member, and thus increasing the cleaning efficiency.

Koichi '466, Otshuka '671 and Ohashi '623, on the other hand, construct a pair of cleaning pads which dean the corona wire by individually holding diametrically opposite portions of the periphery of the corona wire. This cleaning technique however requires a costly cleaning mechanism constructed within the charging device. Moreover, it has been our observation that no corona wire cleaning mechanism has been constructed in a manner in which the cost can be minimized while facilitating the discharging efficiency of the charger.

SUMMARY OF THE INVENTION

Accordingly, it is therefore an object of the present invention to provide an improved image forming device and process.

It is another object to provide an improved corona wire cleaning device for a corona discharge type charger in an image forming apparatus.

It is yet another object to provide an improved corona wire cleaning device for removing contamination of a corona wire of a corona discharge type charger constructed in a cost efficient manner while facilitating the discharging efficiency of the charger.

It is further an object of the present invention to provide an improved corona wire cleaning device for a corona discharge type charger in an image forming apparatus using an electrophotographic process in which a cleaning member is arranged to be in contact with the corona wire for cleaning only during a cleaning operation while remaining separated and spaced-apart from the corona wire during a charging or discharging operation in order to maximize the discharging efficiency of the charger.

These and other objects may be achieved with an improved corona wire cleaning device for a charging unit in an image forming apparatus constructed according to the principles of the present invention to include an elongated shield case having an elongated guide slit formed therein to extend in a lengthwise direction of a corona wire, and a cleaning mechanism resiliently mounted on the elongated guide slit and adapted to traverse along said elongated guide slit to dean the corona wire, for maintaining a cleaning member at a predetermined distance from the corona wire during non-cleaning of the corona wire, and for allowing, upon application of force, the cleaning member to resiliently press against the corona wire and move along the corona wire while being held in frictional contact with the corona wire during cleaning of the corona wire. The cleaning mechanism includes a rigid shaft guide including a bore constructed to grip opposite sides of the elongated guide slit for sliding along the elongated guide slit of the elongated shield case; a cleaning shaft constructed in a T-shaped including a handle, a body inserted into the bore of the rigid shaft guide, and a stopper cylindrically formed at one end of the body for securing the cleaning shaft in the bore of the rigid shaft guide, and an elastic spring disposed between the handle of the cleaning shaft and the rigid shaft guide. The elastic spring allows the cleaning mechanism to maintain the cleaning member at the predetermined distance from the corona wire during non-cleaning of the corona wire, and to allow, in response to application of force upon the handle of the cleaning shaft, the cleaning member to resiliently press against the corona wire and move along the corona wire while being held in frictional contact with the corona wire during cleaning of the corona wire.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
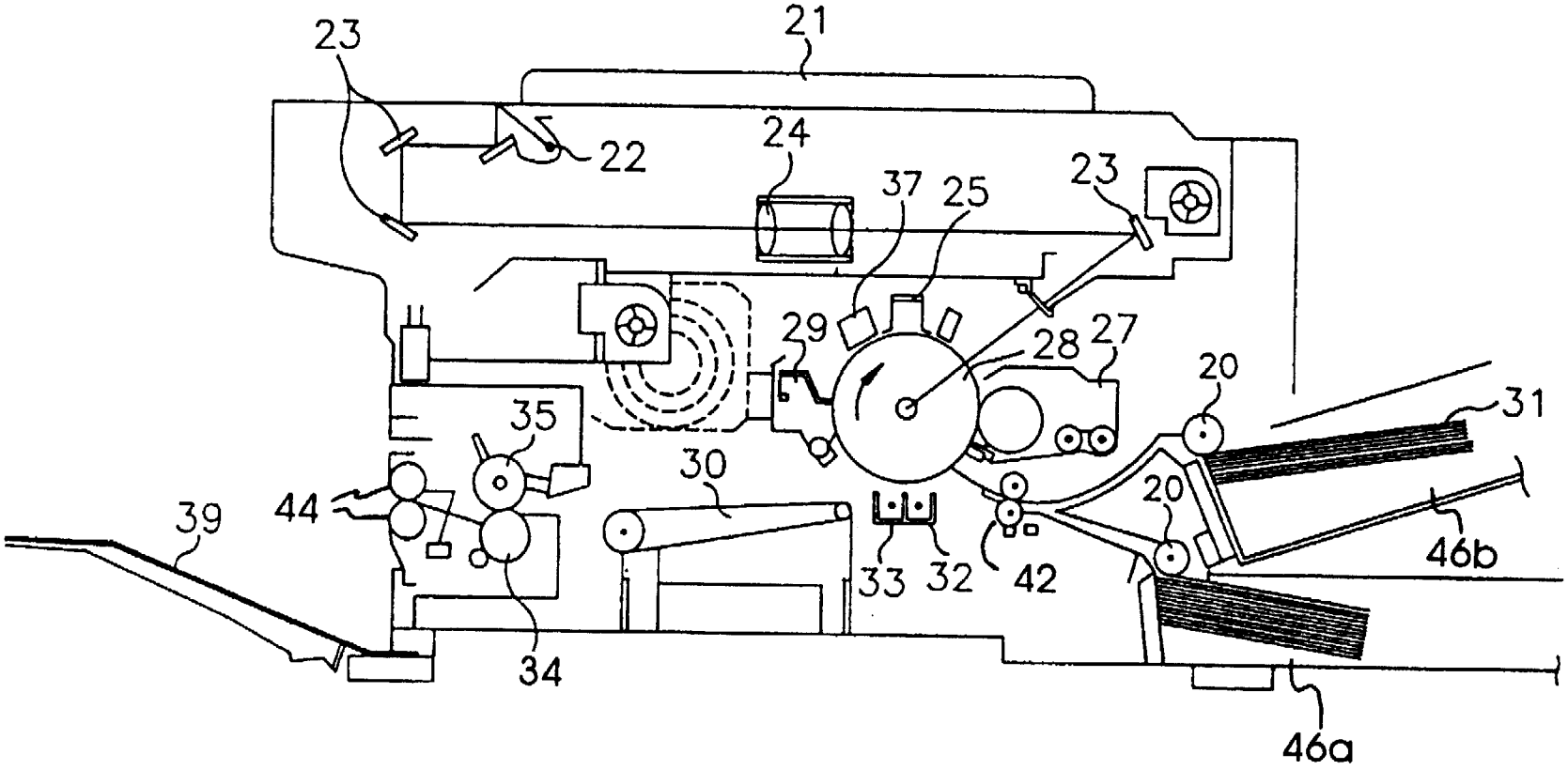
FIG. 1 is an abstract representation illustrating placement of salient components in a conventional image forming apparatus using an electrophotographic process.

Referring now to the drawings and particularly to FIG. 1, which illustrates a conventional image forming apparatus such as, for example, an electrophotographic copier, a laser printer, and alike. A typical image forming apparatus as shown in FIG. 1 includes a document pad 21 in an upper portion; an optical assembly using a light source 22, reflecting mirrors 23 and an imaging lens 24; an imaging assembly constructed with a charging device 25, a developing unit 27, a photosensitive drum 28, a cleaning device 29, a transfer device 32, a separating device 33; a paper transport assembly having a pair of cassettes 46*a*, 46*b* each containing a record medium such as a stack 31 of cut sheet paper, a pair of feed rollers 20 and a pair of registration rollers 42 from an upstream side along a direction of transport of a sheet of the recording paper. The paper transport assembly also includes a transport belt 30, a pressure roller 34, a heating roller 35, a pair of discharge rollers 44, and a discharge tray 39 and the like so as to transport the recording paper separated from the photosensitive drum 28.

Typically, the surface of the photosensitive drum 28 is uniformly charged by corona discharge of a charging device 25, and an electrostatic latent image is formed on the surface of the photosensitive drum 28 by way of light irradiation from a light-emitting diode LED or a laser diode to a charged portion of the photosensitive drum 28, or using a light reflected from the recording paper disposed on a document pad 21 by the light source 22 of an exposure lamp 22. The electrostatic latent image is developed by toner while passing through the developing unit 27, and is then formed as a visual image. The visual image on the photosensitive drum 28 is transferred on the recording paper 31, which is fed from a selected one of the two cassettes 46 and into the image forming apparatus by one of the pair of feed rollers 20 by way of the transfer device 32.

Then, the recording paper is attached to the photosensitive drum 28 by an electrostatic force, and the separating device 33 serves to separate the attached copy paper from the photosensitive drum 28 to be transported by the transport belt 30 into the heating roller 35 and the pressure roller 34. Them, the image of the document is fixed on the recording paper by the combination of heat and pressure, and thus the desired image forming operation is accomplished. After each image forming operation, however, residual toner and latent image remain on the photosensitive drum 28. The toner remaining on the photosensitive drum 28 is typically removed by a cleaning blade of the cleaning unit 29, and the latent image remaining on the photosensitive drum 28 is removed by a pre-erase lamp array 37.

Since the corona discharge which has been widely used in the charging device 25 and transfer unit 32 as mentioned above is generated with a high voltage ranging from about several hundred to several thousand volts, the surface of the corona wire typical attracts extraneous particles which contributes to the deterioration of the quality and life of the charging device and the transfer unit using a corona wire. The corona discharge method is typically classified into corotron and scrotron types. In the charging device 25 built with a corona wire, the charging device 25 of the scrotron type has a corona wire operated at a high negative voltage. By contrast, the charging device 25 of the corotron type operates with the corona wire at a high positive voltage. The scrotron type typically exhibits a more uneven discharge characteristic than the corotron type.

In the image forming apparatus using an electrophotographic process of a reverse developing method, a scrotron type charging device is used. Accordingly, the surface of the photosensitive drum 28 is charged with a negative potential by the charging device 25 of the scrotron type. Hence, the charging device 25 applies a constant voltage (e.g., −550V) to a grid and the shield case of the charging device. A negative voltage of the several thousand volts is applied to the corona wire so as to produce corona discharge. Negative ions are actually discharged from the corona wire, and some of the discharged negative ions pass through the grid so as to charge the surface of the photosensitive drum 28 with about −600 Volts, while other ions flow via the grid and shield case. Then, the vicinity of the corona wire is a state sensitive to the reaction generated by the high pressure, high temperature and the presence of ions. Therefore, the corona wire can be easily deleteriously contaminated.

The charging device 25 as described in FIG. 1 has to uniformly charge the surface of the photosensitive drum with about −600V, but an unevenly charged state is always generated with the scrotron type. Since the uneven charged state exists within the limit of several tens of volts for forming the image when the corona wire is clear, it is possible to form the image above a given level. If the corona wire is contaminated due to the continuous use however, since the uneven charged state exists with variations greater than several tens of volts, this has an adverse influence on the image formation.

Figure 2:
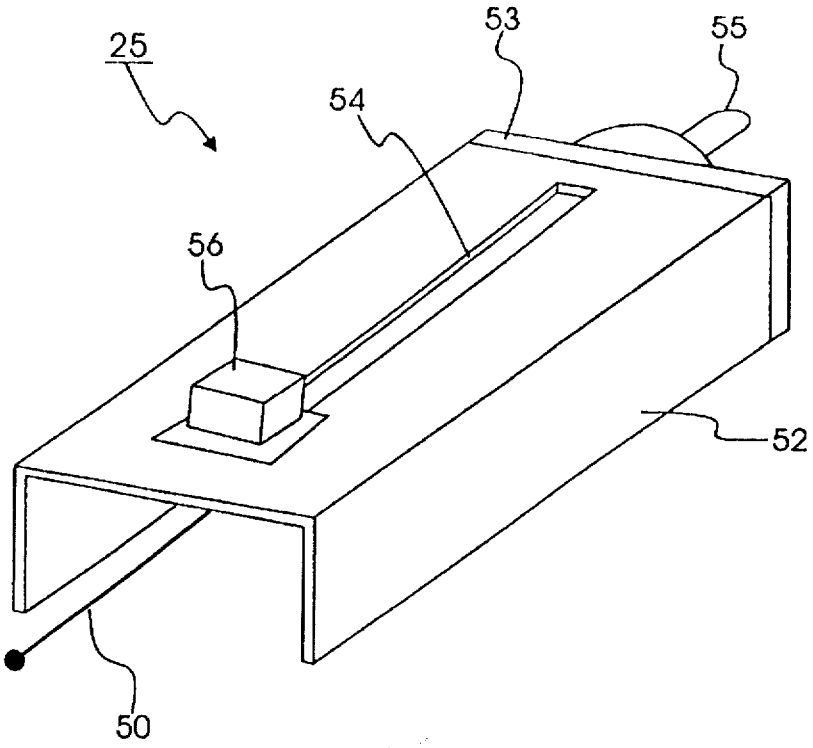
FIG. 2 illustrates a typical cleaning device of a charging unit usable in the conventional image forming apparatus of FIG. 1.

FIG. 2 illustrates the typical charging device 25 for the corona discharge used in the conventional image forming apparatus of FIG. 1. As shown in FIG. 2, a metallic shield case 52 surrounding the corona wire 50 only has an opening or a guide slit 54 in a direction facing toward the photosensitive drum 28. A wire holder 53 is connected to one end of the shield case 52 where an electrode 55 for responding to application of high voltage power is installed, while a fixing holder (not shown) is connected to the opposite end of case 52. The corona wire 50 is disposed between the wire holder 53 and the fixing holder (not shown) in order to maintain a constant tensile force. Thus, when the current of a high voltage flows on the corona wire 50, the corona wire 50 produces the corona discharge. That is, if the current of the high voltage is applied to the corona wire 50 through the electrode 55 of the shield case 52, the corona discharge through the corona wire 50 is produced and the corona discharge is then used to charge the surface of the photosensitive drum 28 so that the toner which has adhered on the photosensitive drum 28 is transferred onto the recording paper 31.

As mentioned above, the conventional image forming apparatus experiences undesirable adhesion of extraneous particles to the corona wire because of high electric field formed on the surface of the charging wire when the corona wire generates a high discharge current for each image forming operation. This contaminates the corona wire and deleteriously reduces the corona discharge characteristics of the charging device.

Figure 3:
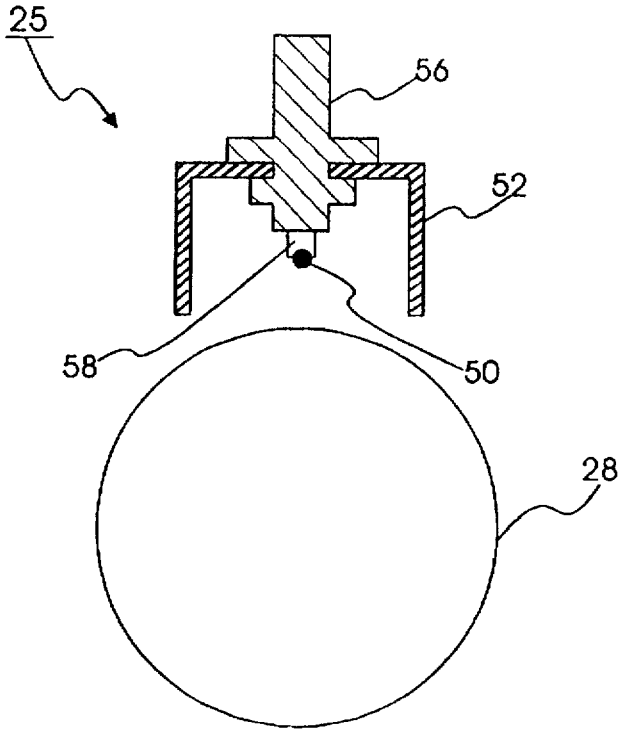
FIG. 3 is a perspective view illustrating a cleaning device of a charging unit usable in the conventional image forming apparatus of FIG. 1.

FIG. 3 illustrates a perspective view illustrating a cleaning device of a charging unit 25 of FIG. 2 usable in the conventional image forming apparatus. The conventional cleaning device includes a cleaning shaft 56 having a cleaning felt attached at one end and constructed to slide along the guide slit 52 in a direction facing toward the photosensitive drum 28. The cleaning felt 58 is positioned to contact with the corona wire 50. This construction allows a user to manually assert force onto the cleaning shaft 56 to move the cleaning felt 58 back and forth along the guide slit 52 in order to clean the corona wire 50. However, since the cleaning felt 58 is arranged in contact with the corona wire 50 at a predetermined position even when not cleaning, it has been my observation that the contact portion of the corona wire 50 could not be efficiently charged which would lower the discharging efficiency of the charging unit 25 and degrade the quality of image reproduction. Moreover, it has also been my observation that if the size of the charging unit 25 is to be enlarged, it would be difficult to construct a cleaning shaft 56 having a cleaning felt 58 capable of effectively cleaning the corona wire 50. More significantly, since the cleaning felt 58 is fixed with respect to the corona wire 50, the user could not regulate or adjust the pressure asserted on the corona wire 50 by the cleaning felt 58 in order to effectively, selectively and manually clean a certain designated portion of the corona wire 50.

Figure 4:
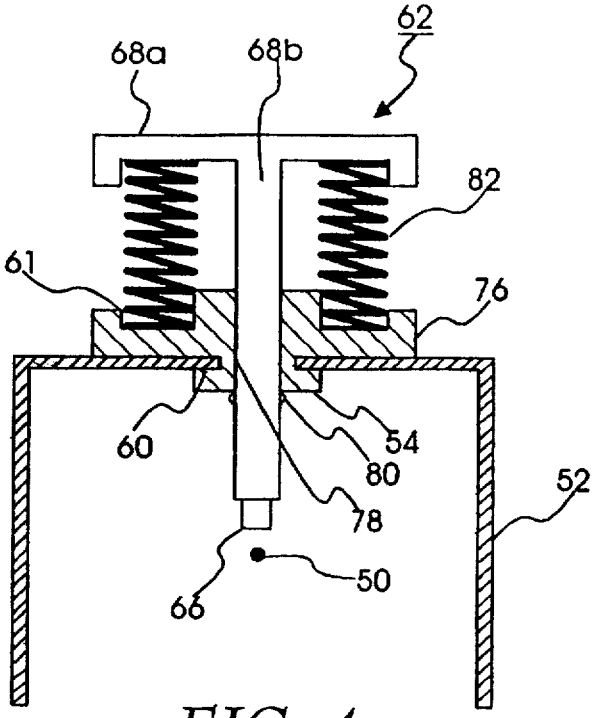
FIG. 4 is a perspective view illustrating the structure of an improved cleaning device of a charging unit in an image forming apparatus constructed according to the principles of the present invention.

Turning now to FIG. 4 which illustrates an improved cleaning device of the charging unit 25 in the image forming apparatus in which a cleaning device structure is constructed to clean a corona wire of a charging unit 25 in a manner that is simple, efficient, and compact. As shown in FIG. 4, the cleaning device of the charging unit in the image forming apparatus using the electrophotographic process according to the principles of the present invention includes an adjustable cleaning shaft 62 constructed in a T-shaped having a handle **68*a* and a body 68*b* with a cleaning felt 66 connected thereon, and a cleaning shaft guide 76 constructed to slide along the opening or the guide slit 54 of the metallic shield case 52 surrounding the corona wire 50 in a direction facing toward the photosensitive drum 28 as shown in FIG. 3. The cleaning shaft guide 76 is constructed with a lower groove 60 for allowing the cleaning shaft guide 76 to grip adjacent sides of the guide slit 54 of the metallic shield case 52 and to allow the user to assert force manually or by way of a computer-operated controller, to move the cleaning shaft 62 back and forth along the corona wire 50, and an upper groove 61 for allowing an elastic body 82 such as, for example, a coil spring contained therein to adjust the position of the cleaning shaft 62 in accordance with the pressure asserted when cleaning the corona wire 50. The cleaning shaft guide 76 also contains therein an opening or a bore 78 in its central portion in which the body 68*b* of the adjustable cleaning shaft 62 is secured therein. A stopper 80 is cylindrically formed at one end of the body 68*b* of the cleaning shaft 62 in order to secure the cleaning shaft 62 in the shield case 52 and prevent the cleaning shaft 62 from escaping the opening or bore 78 while concomitantly defining a distance of which a cleaning felt 66 as connected at the bottom of the cleaning shaft 62 remains from the corona wire 50** during a non-cleaning state.

Figure 5:
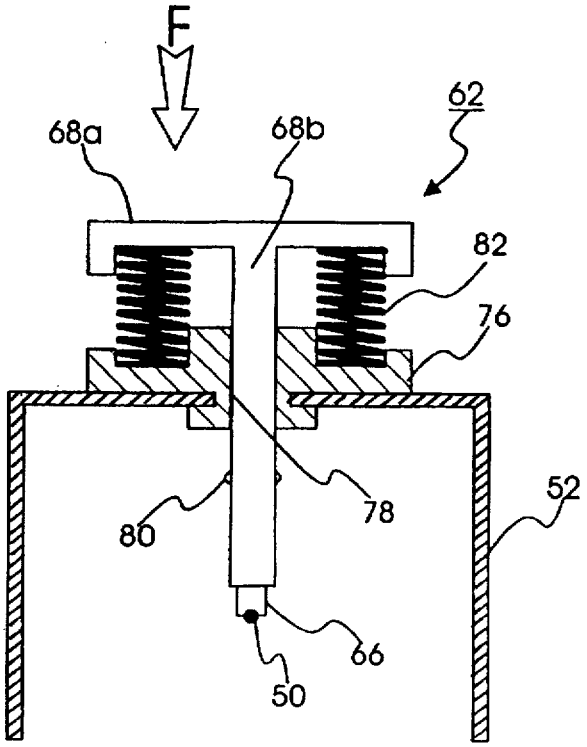
FIG. 5 is a perspective view illustrating operation of an improved cleaning device of a charging unit in an image forming apparatus constructed according to a preferred embodiment of the present invention.

FIG. 5 illustrates, for example, an operation of the improved cleaning device as shown in FIG. 4. First, the user is required to assert force F downward onto the handle 68*a* of the cleaning shaft 62 so as to allow the cleaning felt 66 connected thereto to press against the corona wire 50. Then, the cleaning operation is performed when the cleaning felt 66 is moved back and forth along the length of the corona wire 50 while the cleaning felt 66 is being held in frictional contact with the corona wire 50. The use of an elastic body 82 such as, for example, a spring coil allows the user to adjust the pressure asserted on the corona wire 50 via the cleaning felt 58 at any desirable segments of the corona wire 50 as the cleaning device slides along the guide opening 54 of the metallic shield case 52 in order to effectively clean the corona wire 50 at those desirable segments of the entire corona wire 50. That is, the increase of the pressure asserted by the user translates into an increased frictional resistance between the corona wire 50 and the cleaning felt 66 which, in turn, greatly improves the cleaning efficiency of the corona wire 50. Accordingly, this particular construction advantageously allows the corona wire 50 to be efficiently charged at each charging operation while concomitantly maximizing the discharging efficiency of the charging unit and the quality of image reproduction.

Figure 6:
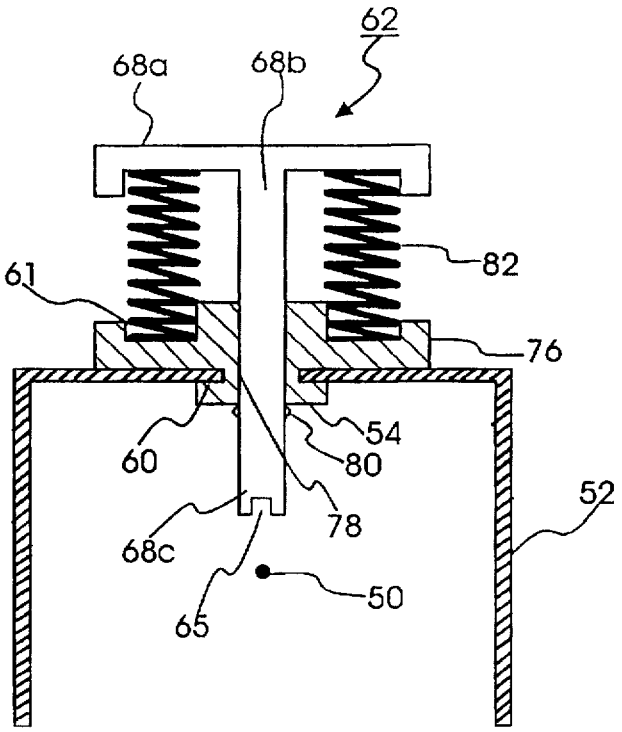
FIG. 6 is a perspective view illustrating the structure of an improved cleaning device of a charging unit in an image forming apparatus constructed according to a second embodiment of the present invention.
Figure 7:
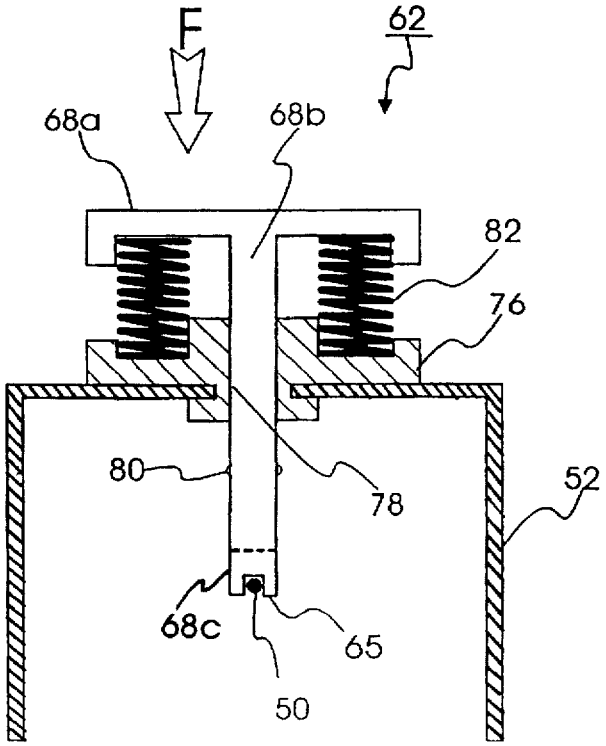
FIG. 7 is a perspective view illustrating operation of an improved cleaning device of a charging unit in an image forming apparatus constructed according to the second embodiment of the present invention.

FIG. 6 is a perspective view illustrating the structure of an improved cleaning device of a charging unit in an image forming apparatus constructed according to a second embodiment of the present invention. This cleaning device is constructed in the same fashion as shown in FIGS. 4 and 5, except for the cleaning member being in a form of a cleaner pad 68*c* attached to the bottom of the cleaning shaft 62. The cleaning pad 68*c* is configured with a sandy groove 65 accommodating the corona wire 50 as the cleaning device is pressed against the corona wire 50 as shown in FIG. 7, and slides along the guide opening 54 of the metallic shield case 52 in order to dean the corona wire 50. The sandy groove 65 contains therein diametrically opposite sides that serve to scrape and effectively remove stains such as, for example, toner and paper powders adhered on the surface of the corona wire 50 while being held in contact with the corona wire 50.

Figure 8:
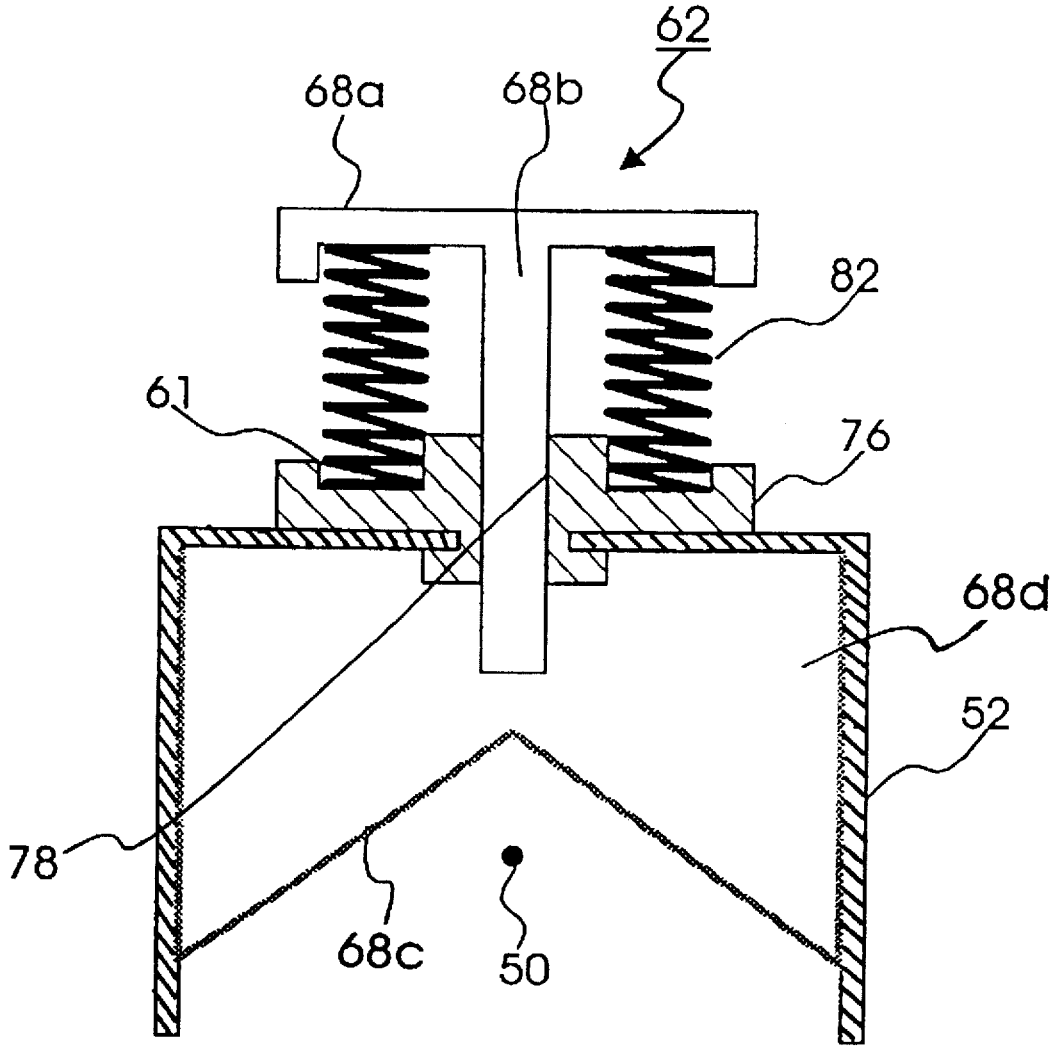
FIG. 8 is a perspective view illustrating the structure of an improved cleaning device of a charging unit in an image forming apparatus constructed according to a third embodiment of the present invention.

FIG. 8 is a perspective view illustrating the structure of an improved cleaning device constructed according to a third embodiment of the present invention intended to remove stains adhered on both the surface of the corona wire 50 as well as the interior of the metallic shield case 52. The cleaning device is comprised of a support plate 68*d* mounted to a bottom end of the body 68*b* of the cleaning shaft 62 so as to be movable along the length of the metallic shield case 52. The support plate 68*d* not only serves as the stopper so in order to prevent the cleaning shaft 62 from escaping the opening 78 of the guide shaft 76, but is also sized so as to fit closely within the shield case 52 so that when a cleaning pad 68*c* such as, for example, an abrasive cloth or pad is mounted thereto, it has a close fit with the corona wire 50 and the shield case 52 in order to remove any dirts and stains adhered to the corona wire 50 and the interior of the shield case 52.

As described above, in the improved cleaning device of the charging unit in the image forming apparatus using the electrophotographic process, since the abnormal image is not generated even though the cleaning shaft is positioned inside of the image width, it is not necessary to enlarge the width of the charging unit (i.e. the length of the corona wire and the shield case). Moreover, since it is now possible to firmly and selectively press the corona wire 50 with the cleaning member such as, for example, a cleaning felt, a cleaning pad, and alike, the corona wire can be effectively cleaned. Further, since the cleaning member is arranged to be in contact with the corona wire for cleaning only during a cleaning operation while remaining separated and spaced-apart from the corona wire during a charging or discharging operation, the discharging efficiency of the charging unit and the quality of image reproduction can be greatly improved.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An image forming apparatus, comprising:

a photosensitive body;

charger means for charging the photosensitive body, said charger means including a corona wire extending in a lengthwise direction of the photosensitive body, and comprising an elongated shield case, and an elongated guide slit formed on said elongated shield case facing said corona wire and extending in a lengthwise direction of said elongated shield case; and a cleaning mechanism resiliently, slidably mounted on the elongated guide slit and adapted to traverse along said elongated guide slit to clean the corona wire, said cleaning mechanism maintaining a cleaning member at a predetermined distance from the corona wire during non-cleaning of the corona wire, and allowing, upon application of force, the cleaning member to resiliently press against the corona wire and move along the corona wire while being held in frictional contact with the corona wire in response to said application of force during cleaning of the corona wire.

2. The image forming apparatus of claim 1, wherein said cleaning mechanism comprises:

a rigid shaft guide constructed to grip opposite sides of said elongated guide slit for sliding along said elongated guide slit of said elongated shield case, said rigid shaft guide containing therein a bore;

a cleaning shaft constructed in a T-shaped including a handle and an integrally connected body inserted into the bore of said rigid shaft guide, said cleaning shaft having a stopper cylindrically formed at one end of the body for securing the cleaning shaft in the bore of said rigid shaft guide, and elastic means disposed between the handle of said cleaning shaft and said rigid shaft guide, for allowing the cleaning member to maintain at said predetermined distance from the corona wire defined by said stopper during non-cleaning of the corona wire, and for allowing, in response to application of force upon the handle of said cleaning shaft, the cleaning member to resiliently press against the corona wire and move along the corona wire while being held in frictional contact with the corona wire during cleaning of the corona wire.

3. The image forming apparatus of claim 2, wherein said cleaning member is a cleaning felt connected to a bottom end of said cleaning shaft.

4. The image forming apparatus of claim 2, wherein said cleaning member is a cleaning pad connected to a bottom end of said cleaning shaft.

5. The image forming apparatus of claim 2, wherein said cleaning member is a cleaning pad connected to a bottom end of said cleaning shaft, said cleaning pad containing therein a groove for accommodating the corona wire in order to clean the corona wire while being held in frictional contact with the corona wire.

6. The image forming apparatus of claim 2, wherein said cleaning member is a cleaning pad connected to a bottom end of said cleaning shaft extending across the interior of the elongated shield case for cleaning both the corona wire and the interior of the elongated shield case, when said cleaning mechanism is pressed against the corona wire and traverses along said elongated guide slit to clean the corona wire, while being held in frictional contact with the corona wire during cleaning of the corona wire.

7. The image forming apparatus of claim 6, wherein said elastic means is a pressing coil spring.

8. The image forming apparatus of claim 2, wherein said elastic means is a pressing coil spring.

9. The image forming apparatus of claim 1, wherein said cleaning member is a cleaning pad extending across the interior of the elongated shield case for cleaning both the corona wire and the interior of the elongated shield case, when said cleaning mechanism is pressed against the corona wire and traverses along said elongated guide slit to clean the corona wire, while being held in frictional contact with the corona wire during cleaning of the corona wire.

10. A cleaning device of a charging unit in an image forming apparatus using an electrophotographic process for cleaning a corona wire, said cleaning device comprising:

a metallic shield case having a guide slit formed in a central portion extending in a lengthwise direction of a photosensitive drum;

a cleaning shaft guide containing a bore therein, mounted to the side slit and adapted to slide along the guide slit; and a cleaning shaft having a handle and an integrally connected body inserted into the bore and adapted to maintain a cleaning member at a distance from the corona wire during non-cleaning of the corona wire, and to allow, upon application of force, the cleaning member to resiliently press against the corona wire and move along the corona wire while being held in frictional contact with the corona wire during cleaning of the corona wire.

11. The cleaning device of claim 10, further comprising elastic means disposed between the handle of the cleaning shaft and the cleaning shaft guide, for allowing the cleaning shaft to elastically oscillate in said bore in a vertical direction with respect to said cleaning shaft guide.

12. The cleaning device of claim 11, further comprised of said elastic means being a pressing coil spring.

13. The cleaning device of claim 10, further comprising a stopper cylindrically formed at one end of said cleaning shaft, for securing the cleaning shaft in the bore of said rigid shaft guide.

14. A charger device, comprising:

a corona discharge wire;

a photosensitive drum;

an elongated conductive shield having a generally U-shaped cross section and a guide slit extending in a lengthwise of the photosensitive drum;

a cleaning shaft guide containing a bore therein, mounted to the guide slit and adapted to slide along the guide slit; and a cleaning shaft having a handle and an integrally connected body inserted into the bore and adapted to maintain a cleaning member at a distance from the corona wire during non-cleaning of the corona wire, and to allow, upon application of force, the cleaning member to resiliently press against the corona wire and move along the corona wire while being held in frictional contact with the corona wire during cleaning of the corona wire by way of elastic materials disposed between the handle of the cleaning shaft and the cleaning shaft guide.

15. The charger device of claim 14, wherein said cleaning member is a cleaning felt connected to a bottom end of the body of said cleaning shaft.

16. The charger device of claim 15, further comprised of said cleaning shaft being resilient to accommodate manipulation of force asserted for allowing the cleaning felt to clean only selected segments of the corona wire.

17. The charger device of claim 14, wherein said cleaning member is a cleaning pad connected to a bottom end of the body of said cleaning shaft.

18. The charger device of claim 17, wherein said cleaning member is a cleaning pad connected to a bottom end of the body of said cleaning shaft extending across the interior of the elongated conductive shield case for cleaning both the corona wire and the interior of the elongated conductive shield case, when said cleaning member is pressed against the corona wire and traverses along said guide slit to clean the corona wire, while being held in frictional contact with the corona wire during cleaning of the corona wire.

19. The charger device of claim 17, further comprised of said cleaning shaft being resilient to accommodate manipulation of force asserted for allowing the cleaning pad to clean only selected segments of the corona wire.

20. The charger device of claim 14, wherein said cleaning member is a cleaning pad connected to a bottom end of the body of said cleaning shaft, said cleaning pad containing therein a groove for accommodating the corona wire in order to clean the corona wire while being held in frictional contact with the corona wire.

21. A charger, comprising:

an elongated shield case having an elongated guide slit formed in a central portion extending in a lengthwise direction of a photosensitive drum; and a movable cleaning mechanism comprising:

a rigid shaft guide constructed to grip opposite sides of said elongated guide slit for sliding along said elongated guide slit of said elongated shield case, said rigid shaft guide including therein a bore;

a cleaning shaft constructed in a T-shaped including a handle and an integrally connected body inserted into the bore of said rigid shaft guide and adapted to maintain a cleaning member at a predetermined distance from a charging wire during non-cleaning of the charging wire, said cleaning shall having a stopper cylindrically formed at one end of the body for securing the cleaning shaft in the bore of said rigid shaft guide; and elastic means disposed between the handle of said cleaning shaft and said rigid shaft guide, for allowing the cleaning member to maintain at said predetermined distance from the charging wire defined by said stopper during non-cleaning of the charging wire, and for allowing, in response to application of force upon the handle of said cleaning shaft, the cleaning member to resiliently press against the charging wire and move along the charging wire while being held in frictional contact with the charging wire in response to said application of force during cleaning of the charging wire.

22. The charger of claim 21, wherein said cleaning member is a cleaning felt connected to a bottom end of said rigid cleaning shaft.

23. The charger of claim 21, wherein said cleaning member is a cleaning pad connected to a bottom end of said rigid cleaning shaft.

24. The charger of claim 21, wherein said cleaning member is a cleaning pad connected to a bottom end of said cleaning shaft, said cleaning pad containing therein a groove for accommodating the charging wire so as to clean the charging wire while being held in frictional contact with the charging wire in response to said application of force during said cleaning of the charging wire.

25. The charger of claim 21, wherein said cleaning member is a cleaning pad connected to a bottom end of said rigid cleaning shaft extending across the interior of the elongated shield case for cleaning both the charging wire and the interior of the elongated shield case, when said cleaning member is pressed against the charging wire and said movable cleaning mechanism traverses along said elongated guide slit to clean the charging wire, while said cleaning member is being held in frictional contact with the charging wire during cleaning of the charging wire.

* * * * *